US011953293B1

(12) United States Patent
Glenn

(10) Patent No.: US 11,953,293 B1
(45) Date of Patent: Apr. 9, 2024

(54) COMPACT FOLDING BALLISTIC BODY ARMOR SYSTEM

(71) Applicant: Tyler Cameron Glenn, Westlake Village, CA (US)

(72) Inventor: Tyler Cameron Glenn, Westlake Village, CA (US)

( * ) Notice: Subject to any disclaimer, the term of this patent is extended or adjusted under 35 U.S.C. 154(b) by 0 days.

(21) Appl. No.: 18/471,847

(22) Filed: Sep. 21, 2023

(51) Int. Cl.
*F41H 1/02* (2006.01)

(52) U.S. Cl.
CPC ..... *F41H 1/02* (2013.01)

(58) Field of Classification Search
CPC ..... F41H 1/02; F41H 5/08
USPC ..... 2/2.5; 89/36.05
See application file for complete search history.

(56) References Cited

U.S. PATENT DOCUMENTS 1,277,706 A * 9/1918 Dorfman ..... F41H 1/02 2/2.5
2,921,317 A * 1/1960 Tifft ..... F41H 5/08 2/2.5
5,392,686 A * 2/1995 Sankar ..... F41H 5/08 109/49.5
5,756,922 A 5/1998 Fuller
6,098,196 A * 8/2000 Logan ..... F41H 1/02 2/2.5
6,161,738 A 12/2000 Norris
6,685,071 B2 2/2004 Prather
7,441,278 B2 10/2008 Blakeley
9,027,810 B1 5/2015 Piersol
9,801,452 B2 10/2017 Duthoit
10,130,160 B1 11/2018 Cheng et al.
10,213,008 B2 2/2019 Weaver, Jr. et al.
10,897,971 B2 1/2021 Taha
10,939,713 B2 3/2021 Walsh et al.
10,955,223 B1 * 3/2021 Guyette ..... F41H 5/013
10,962,334 B2 3/2021 Ahrens
11,181,343 B2 11/2021 Ross
2003/0221256 A1 * 12/2003 Monk ..... F41H 5/08 5/722
2007/0295772 A1 12/2007 Woodmansee
2014/0196203 A1 * 7/2014 Cole ..... F41H 1/02 24/305
2019/0154405 A1 5/2019 Burnau et al.
2019/0174903 A1 6/2019 Holder
2019/0212097 A1 7/2019 McDonald
2020/0132417 A1 4/2020 Xiang
2020/0256647 A1 * 8/2020 Howell ..... F41H 5/0407
2020/0263959 A1 8/2020 Dieffenbach
2021/0000246 A1 1/2021 Alson

* cited by examiner

*Primary Examiner* — Tajash D Patel
(74) *Attorney, Agent, or Firm* — Dunlap Bennett & Ludwig, PLLC

(57) ABSTRACT

A foldable ballistic body armor system having a linear arrangement of body panels. The linear arrangement of body panels includes a central body panel from which a front subset of body panels depends from a front edge of the central body panel while a rear subset of body panels depends from a front edge of the central body panel so that when a user crowns the central body panel, the front and rear body panels protect the front and rear flanks of the user under the urging of gravity in a deployment condition defining a rectangular prism. Each body panel is pivotably connected to its adjacent so that the overall system is foldable between a storage condition and the deployment condition.

20 Claims, 4 Drawing Sheets

COMPACT FOLDING BALLISTIC BODY ARMOR SYSTEM

BACKGROUND OF THE INVENTION

The present invention relates to ballistic body armor and, more particularly, to a compact folding ballistic body armor system.

Protecting the lives of good people from gun violence in a moment's notice is very difficult. Current body armor systems are hard to store, take a long time to put on, and do not offer full protection in the face of indiscriminate shooting.

Specifically, current body armor systems are trying to conform to the odd human body shape, and thus when worn leave very large gaps or windows of space through which a bullet can pass and directly hit the wearer.

Furthermore, current body systems can take minutes to put on, which is too long when facing the immediate and sudden existential threat of an active shooter.

As can be seen, there is a need for a compact folding ballistic body armor system that provides essentially full body protection.

SUMMARY OF THE INVENTION

The present invention employs panels that drape from the crown of the user, walling off space between the armor and the wearer. The present invention eschews conforming to the body of the wearer, but rather employs a series of rectangular panels hinged together so that gravity driven deployment results in a rectangular prismatic configuration, thereby the ballistic body armor expeditiously shields the entire body in mere moments.

Forming rectangular prismatic configuration through draping the series of pivotably-connected rectangular panels under the force of gravity optimizes protection and deployment, while minimizing cost and weight. In contrast, current body arm attempts to fit around the groin of the wearer, which delays deployment and does not protect any part of the wearer's legs.

The body armor system of the present invention moves between an unfolded deployment condition to a folded storage condition in a matter of seconds and provides greater cover area of protection than current body armor systems. Since the present invention is made out rectangular panels instead of form-fitting shapes the present invention is also cheaper to mass produce and offers far greater ballistic resistance. The rectangular panels can also be made to be much stronger and lighter than form fitting vest components.

In one aspect of the present invention, a foldable ballistic body armor includes a linear arrangement of at least five body panels, wherein each body panel is pivotably connected to an adjacent body panel so that when a central body panel of the at least five of body panels is crowned on a user, a deployment condition is urged by gravity, wherein the deployment condition defines a rectangular prism.

In another aspect of the present invention, the foldable ballistic body armor, further includes the following: a neck strap configured to secure the linear arrangement of at least five body panels about a neck of the user; a waist configured to secure the linear arrangement of at least five body panels about a waist of the user, wherein the linear arrangement of at least five body panels is movable between the deployment condition to a folded storage condition by way of said pivotable connections, wherein the linear arrangement of at least five body panels is seven or more body panels, wherein a facial body panel of the at least five body panels provide a visor, wherein a majority of the at least five body panels are rectangular in shape, further including side panels depending from opposing side edges of the central body panel, wherein the at least five body panels comprise a front subset of body panels and a rear subset of body panels that depend from opposite edges of the central body panel; and further including magnets disposed along opposing side edges of the front and rear subsets of body panel so as to magnetically connect the front and rear subsets of body panels in the deployment condition.

These and other features, aspects and advantages of the present invention will become better understood with reference to the following drawings, description and claims.

DETAILED DESCRIPTION OF THE INVENTION

Figure 1:
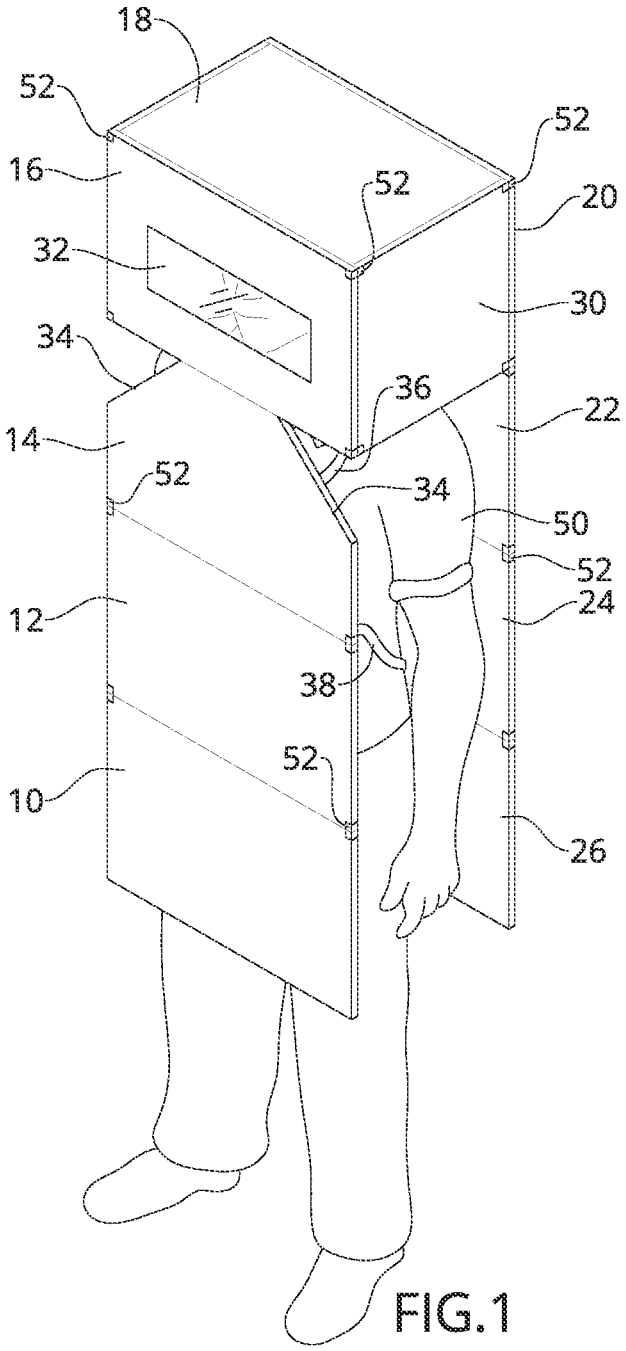
FIG. 1 is a perspective view of an exemplary embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a foldable ballistic body armor system having a linear arrangement of body panels. The linear arrangement of body panels includes a central body panel from which a front subset of body panels depends from a front edge of the central body panel while a rear subset of body panels depends from a rear edge of the central body panel so that when a user crowns the central body panel, the front and rear body panels protect the front and rear flanks of the user, respectively, wherein initial deployment may be achieved under the urging of gravity, defining a rectangular prism shielding the front and rear of the user. The sides of the wearer may be further shielded by joining the lateral edges of the front and rear body panels. Each body panel is pivotably connected to its adjacent panel so that the overall system is foldable between a storage condition and the deployment condition.

Referring to FIGS. 1 through 9, the present invention is a foldable ballistic body armor system 100. The foldable ballistic body armor system 100 includes a linear arrangement of plurality of body panels 10, 12, 14, 16, 18, 20, 22, 24, and 26, wherein each body panel is hinged to each adjacent body panel. A central body panel 18 of the linear arrangement of plurality of body panels is approximately midpoint thereof. The central body panel 18 has one or more side panels 28, 30 on each of its opposing side edges (these side or lateral edges being orthogonal to the direction of the remaining linearly arranged body panels). The ballistic body armor system 100 includes a neck strap 36 and a waist strap 38 for securing the unfolded ballistic body armor system 100 to a wearer in the unfolded deployment condition. The ballistic body armor system 100 also provides at least one panel securing strap 42 for binding the plurality of body panels in the folded, storage condition.

To achieve a desired level of protection, the ballistic filler for the panels of the body armor system 100 is configured to inhibit the complete penetration of a particular ballistic threat by overcoming the energy associated with the ballistic event. The ballistic filler includes high strength fibers routinely used to generate anti-ballistic ply structures.

Figure 7:
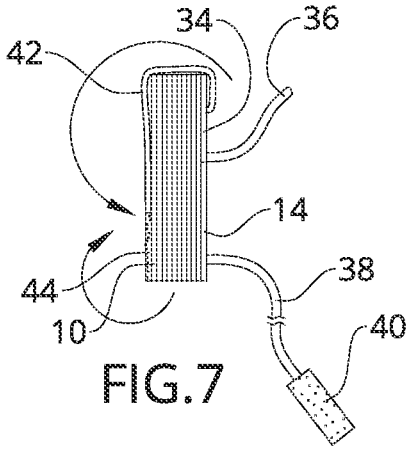
FIG. 7 is a side elevation view of an exemplary embodiment of the present invention, showing the body armor system in the folded condition, illustrating the use of panel securing straps 42 to secure the plurality of panels in a storage condition.
Figure 8:
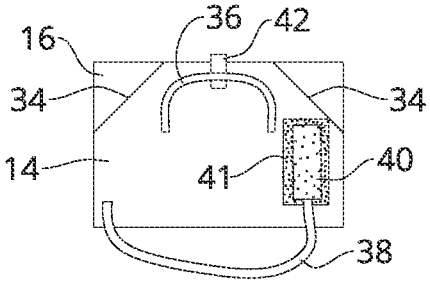
FIG. 8 is a rear elevation view of an exemplary embodiment of the present invention, showing the body armor system in the folded, storage condition.
Figure 9:
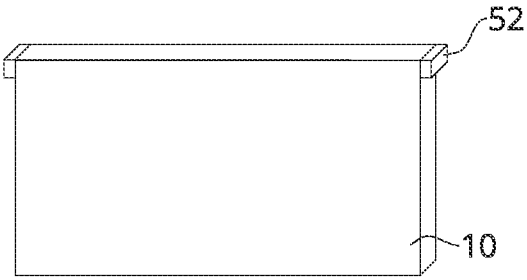
FIG. 9 is a perspective view of an exemplary embodiment of the present invention, showing an enlarged view of a panel so as to illustrate a magnetic attachment point 52.

Each joined edge 15 between panels provides a pivotable attachment, hinge, or the like, thereby enabling each panel to fold relatively to the adjacent panel so that the overall ballistic body armor system 100 is movable between a folded condition and an unfolded condition. The folded condition is illustrated in FIGS. 7 and 8, wherein all the panels of the ballistic body armor system 100 are arranged in a parallel, non-planar orientation. In this parallel, non-planar orientation the panel securing strap 42 may engage a securing fastener 44 disposed along the outer surface of one of the plurality body panels so as to secure the plurality of folded panels together.

Figure 2:
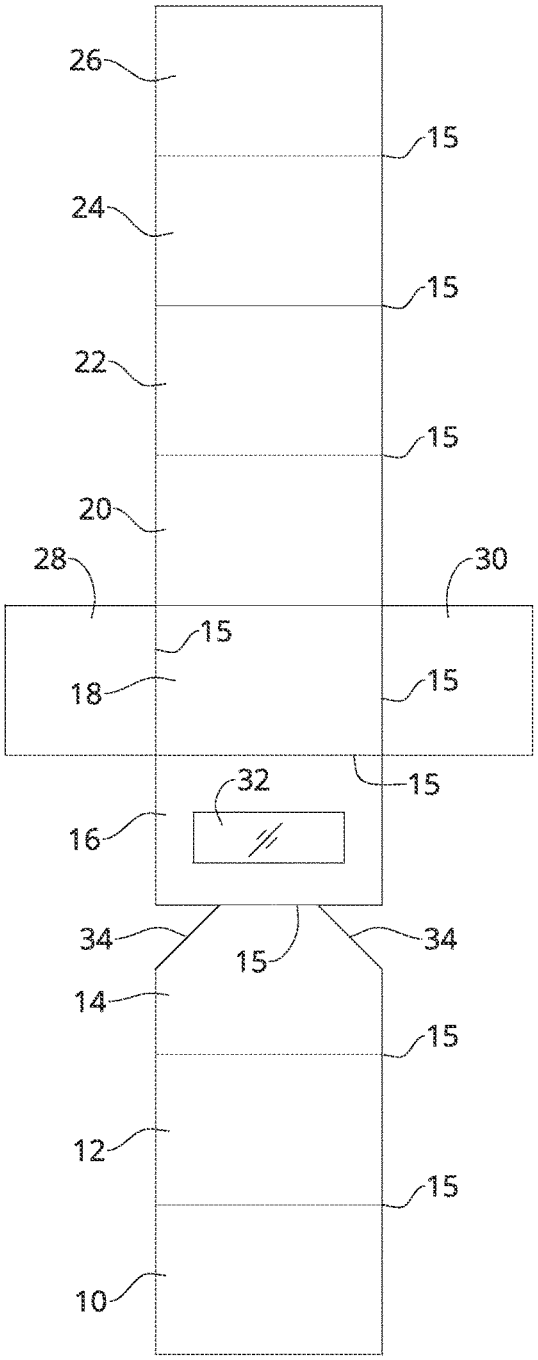
FIG. 2 is a plan view of an exemplary embodiment of the present invention, illustrating the body armor system in an unfolded flat condition.
Figure 3:
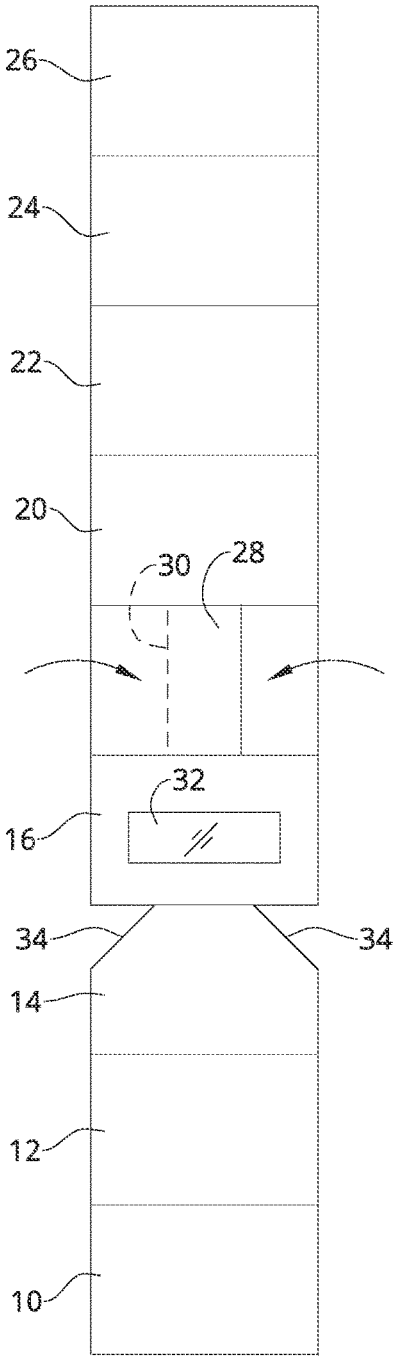
FIG. 3 is a plan view of an exemplary embodiment of the present invention, illustrating the body armor system in the unfolded flat condition with side panels 28, folded over the central body panel 18, defining a linear configuration.
Figure 4:
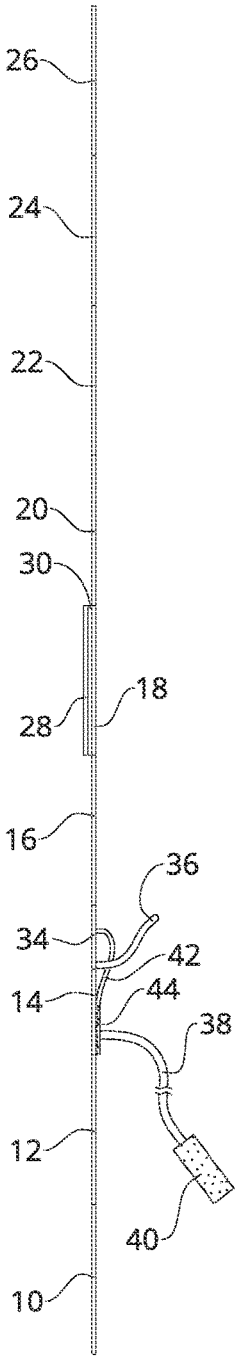
FIG. 4 is a side elevation view of FIG. 3, illustrating the body armor system in the linear configuration.
Figure 5:
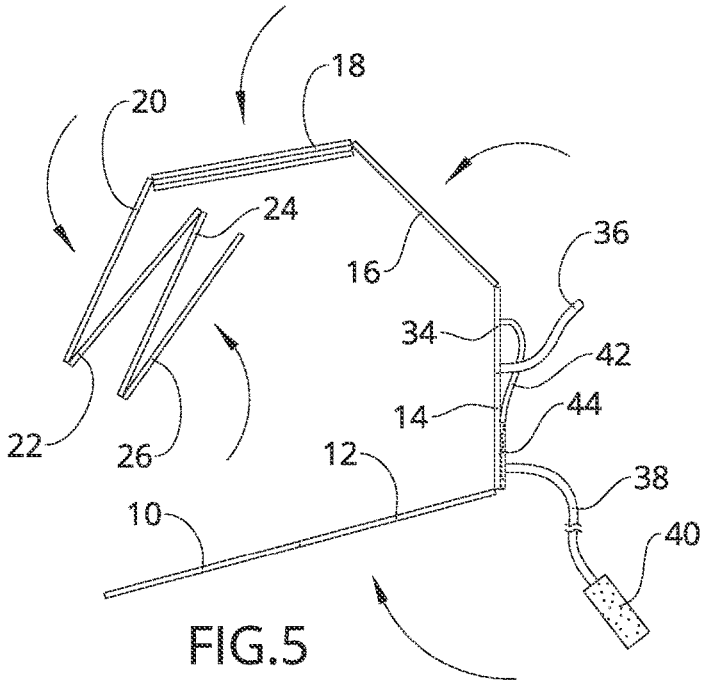
FIG. 5 is a side elevation view of an exemplary embodiment of the present invention, illustrating the body armor system previously in the linear configuration moving to a folded condition by way of the hinged connections between the panels.
Figure 6:
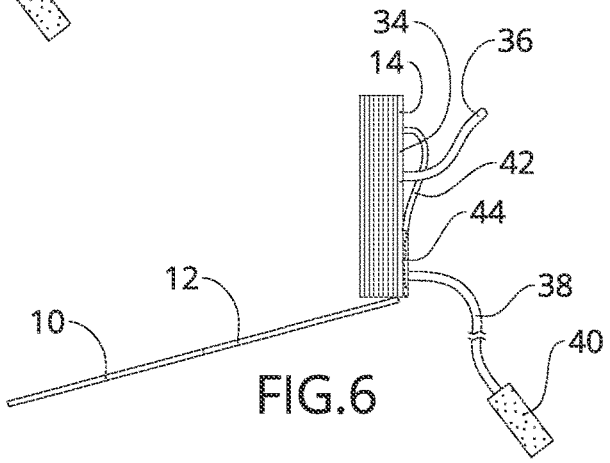
FIG. 6 is a side elevation view of an exemplary embodiment of the present invention, illustrating the body armor system in the folded condition but for the first and second panels 10, 12.

In the unfolded condition, the central body panel 18 provides the opposing sides panels 28, 30 that pivot about their respective joined edges from the folded position (overlapping the central body panel 18) to an unfolded position coplanar with the plurality of body panels in the unfolded condition, as illustrated in FIG. 2, wherein the unfolded position the side panels 28, 30 provide protection of the lateral portions of the head of the user 50.

In a deployed state, the central body panel 18 may crown the user 50, i.e., be supported on an upper surface of their head, while a rear/first subset of body panels depends approximately orthogonal from the central body panel 18 to shield a rear portion of the user 50 from their head to mid to lower legs. Also in the deployed state, a front/second subset of body panels depend approximately orthogonal from the central body panel 18 to shield a front portion of the user 50 from their head to mid to lower legs.

A face panel 16, the panel depending directly from the front edge of the central body panel 18 may provide a visor 32, enabling the user 50 to view their environment. The throat panel 14 depending directly from the facial panel 16 may have cutout corners 34 to facilitate holding a firearm with both hands, because without the cutout corners, the arms would have restricted movement to go up/down and move/aim the weapon.

A neck strap 36 may be attached to the throat panel 14. The neck strap 36 may be dimensioned and shaped to allow the neck strap 36 to fit comfortably around the shoulders/neck of an average adult. Likewise, the waist strap 38 is dimensioned and shaped to fit comfortably around the waist of an average adult. A connection point 40 (provided by a connection pad 41 joined to one of the plurality of panels) is adapted to engage a complementary connector of the waist strap 38. The neck and waist strap 36, 38 work in conjunction with the body armor system 100 to removably attach to a user 50 much like an apron.

The body armor system 100 may include a release strap 42 adapted to be pulled freeing the panels to be thrown over the head to then fall into place. Using straps on each other the panels they can fold up and fold out to be compacted or deployed and aligned with each other.

The magnetic attachments 52 (which may be any shape, size or magnetic strength required to effectuate the functionality disclosed herein) on the side of the panels lock the panels into place to protect around the body. These magnetic locks are strong enough to keep the system together when being impacted but weak enough to fold the system back up. The system is a varying number of ballistic panels that are attached using an arrangement of straps and magnets attachment 52 that when deployed creates a box/rectangular prism around the body. This box has far greater ballistic capabilities than other current body armor systems and takes up a fraction of the space and fraction of time to deploy. In certain embodiments, magnetic attachment points on the panels may automatically connect and secure the front and rear subsets of body panels along opposing lateral edges. The magnetic attachments 52 may be embedded within each panel, or be otherwise integrated thereto.

Once the system is rested on the body using the two secure-point neck and waist straps 36, 38 it is ready to be deployed. This system only works because all the ballistic parts are flat rectangles. In contrast, current body armor systems that conforms to the user's body ("form-fitting") that is not made of flat shaped panels, and so would never be able to fold up properly.

A method of using the present invention may include the following. Any person that needs ballistic protection at a moment's notice may deploy foldable ballistic body armor system 100. The applications are for military, law enforcement, private security, and home/personal civilian defense. A military/law enforcement application could call for full or half body protection based on the different embodiments of the present invention available and the amount of gunfire at hand. When secured in the folded condition, the user 50 may pull the release strap on the front or back. Once the pull strap is released the system deploys using gravitational force, urging the system to fall into place and be deployed in seconds, with the user 50 resting the central body panel 18 on the crown of their head, and the first and second subsets shielding their rear and front flanks. Accordingly, the present invention does not need to be charged and will always reliably deploy. Once the system falls into place the magnetic attachment 52 points secure it creating a full 360 ballistic support system, affording far greater ballistic protection and energy distribution than any other system.

The element of using rectangular ballistic panels instead of odd shapes is necessary because without flat pieces, the system will not be able to fold up into the most compact size nor can it be deployed as fast as it can. The magnetic attachments 52 can be replaced with other easy to use or automatic attach/detach connectors, like hook and loop, snaps, etc. An elastic fabric for the panel connecting straps that does not wear out will make the invention last far longer.

Since the system is handmade, it allows for complete customization to fit the user's needs through providing a ⅓ body, a ½ body, and/or a full body armor system. They can also choose to have protection on the sides or not. The ballistic panels can also be swapped out for non-ballistic components to decrease weight and cost, such as on top of the head. Every panel can be seen as modular, but they come together using the straps/magnets to make it one complete gapless system.

Additionally, the system embodied by the present invention can be fitted with any type of panel. They can either be rated to stop bullets, stab proof, or objects thrown. For example, riot police do not need a full set of ballistic armor, but this system could be anti-impact for full head and chest coverage.

It should be noted that even though the Figures only show a certain amount of the body panels 10 12, 14, 16, 18, 20, 22, 24, 26 and side panels 30, 28, it is understood that a different amount of body and side panels may be employed, and thus the length that they depend from the central body panel 18 varies between embodiments.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A foldable ballistic body armor comprising:

a linear arrangement of at least five body panels, wherein each body panel of the at least five body panels is pivotably connected to an adjacent body panel of the at least five body panels so that when a central body panel of the at least five of body panels is crowned on a user, a deployment condition is urged by gravity, wherein the deployment condition defines a rectangular prism, and wherein a facial body panel of the at least five body panels provide a visor.

2. The foldable ballistic body armor of claim 1, further comprising a neck strap configured to secure the at least five body panels about a neck of the user.

3. The foldable ballistic body armor of claim 1, further comprising a waist strap configured to secure the at least five body panels about a waist of the user.

4. The foldable ballistic body armor of claim 1, wherein the at least five body panels are movable between the deployment condition to a folded storage condition by way of a plurality of pivotable connections.

5. The foldable ballistic body armor of claim 1, wherein a majority of the at least five body panels are rectangular in shape.

6. The foldable ballistic body armor of claim 1, further comprising side panels depending from opposing side edges of the central body panel.

7. The foldable ballistic body armor of claim 1, wherein the at least five body panels comprise a front subset of body panels and a rear subset of body panels that depend from opposite edges of the central body panel.

8. The foldable ballistic body armor of claim 7, further comprising magnets disposed along opposing side edges of the front and rear subsets of body panel so as to magnetically connect the front and rear subsets of body panels in the deployment condition.

9. A foldable ballistic body armor comprising:

a linear arrangement of at least five body panels, wherein each body panel of the at least five body panels is pivotably connected to an adjacent body panel of the at least five body panels so that when a central body panel of the at least five of body panels is crowned on a user, a deployment condition is urged by gravity, wherein the deployment condition defines a rectangular prism; and side panels depending from opposing side edges of the central body panel.

10. The foldable ballistic body armor of claim 9, further comprising a neck strap configured to secure the at least five body panels about a neck of the user.

11. The foldable ballistic body armor of claim 9, further comprising a waist strap configured to secure the at least five body panels about a waist of the user.

12. The foldable ballistic body armor of claim 9, wherein the at least five body panels are movable between the deployment condition to a folded storage condition by way of a plurality of pivotable connections.

13. The foldable ballistic body armor of claim 9, wherein a majority of the at least five body panels are rectangular in shape.

14. The foldable ballistic body armor of claim 9, wherein the at least five body panels comprise a front subset of body panels and a rear subset of body panels that depend from opposite edges of the central body panel.

15. The foldable ballistic body armor of claim 14, further comprising magnets disposed along opposing side edges of the front and rear subsets of body panel so as to magnetically connect the front and rear subsets of body panels in the deployment condition.

16. A foldable ballistic body armor comprising:

a linear arrangement of at least five body panels, wherein each body panel of the at least five body panels is pivotably connected to an adjacent body panel of the at least five body panels so that when a central body panel of the at least five of body panels is crowned on a user, a deployment condition is urged by gravity, wherein the deployment condition defines a rectangular prism, wherein the at least five body panels comprise a front subset of body panels and a rear subset of body panels that depend from opposite edges of the central body panel.

17. The foldable ballistic body armor of claim 16, further comprising a neck strap configured to secure the at least five body panels about a neck of the user.

18. The foldable ballistic body armor of claim 16, further comprising a waist strap configured to secure the at least five body panels about a waist of the user.

19. The foldable ballistic body armor of claim 16, wherein the at least five body panels are movable between the deployment condition to a folded storage condition by way of a plurality of pivotable connections.

20. The foldable ballistic body armor of claim 16, wherein a majority of the at least five body panels are rectangular in shape.

* * * * *